US008966710B1

(12) United States Patent
Lozano

(10) Patent No.: US 8,966,710 B1
(45) Date of Patent: Mar. 3, 2015

(54) SKIN CLEANING ASSEMBLY

(76) Inventor: Silvestre Lozano, Winnetka, CA (US)

( * ) Notice: Subject to any disclaimer, the term of this patent is extended or adjusted under 35 U.S.C. 154(b) by 432 days.

(21) Appl. No.: 13/356,719

(22) Filed: Jan. 24, 2012

(51) Int. Cl.
*A46B 13/02* (2006.01)
*A47L 9/06* (2006.01)

(52) U.S. Cl.
USPC ..... 15/400; 15/23; 15/28

(58) Field of Classification Search
USPC ..... 15/400, 416, 417, 22.1, 23, 24, 28, 29, 15/110, 111
See application file for complete search history.

(56) References Cited

U.S. PATENT DOCUMENTS 3,739,415 A * 6/1973 Larson ..... 15/23
3,775,800 A 12/1973 Veneziani
5,311,860 A * 5/1994 Doria ..... 601/103
5,500,972 A 3/1996 Foster
5,647,841 A 7/1997 Groenewold et al.
5,662,593 A 9/1997 Tillman et al.
5,704,903 A 1/1998 Jahnke
5,891,063 A 4/1999 Vigil
6,032,313 A * 3/2000 Tsang ..... 15/22.1
6,170,108 B1 1/2001 Knight
6,732,394 B1 5/2004 Waterman
7,503,715 B2 3/2009 Khubani
8,032,967 B2 * 10/2011 Jimenez ..... 15/110
2011/0016648 A1 * 1/2011 Kunita et al. ..... 15/22.1

* cited by examiner

*Primary Examiner* — Robert Scruggs

(57) ABSTRACT

A skin cleaning assembly includes a housing that has a first end and a second end. The first end comprises a head that has a circular shape. The second end comprises a handle. The head includes a front wall, a back wall, and a perimeter wall extending between the front and back walls. A cleaning disk is rotatably coupled to the housing and is positioned in and extends away from the front wall. The cleaning disk includes a plurality of bristles. A massage disk is rotatably coupled to the housing and is positioned in and extends away from the back wall. The massage disk includes a plurality of hemispherical massagers. A control circuit is mounted to the housing. The control circuit is actuated to rotate the cleaning disk and actuated to oscillate the massage disk.

1 Claim, 5 Drawing Sheets

SKIN CLEANING ASSEMBLY

BACKGROUND OF THE DISCLOSURE

Field of the Disclosure

The disclosure relates to skin cleaning devices and more particularly pertains to a new skin cleaning device for cleaning a person's body.

SUMMARY OF THE DISCLOSURE

An embodiment of the disclosure meets the needs presented above by generally comprising a housing that has a first end and a second end. The housing is elongated along a longitudinal axis extending through the first and second ends. The first end comprises a head that has a circular shape. The second end comprises a handle. The head includes a front wall, a back wall, and a perimeter wall extending between the front and back walls. A cleaning disk is rotatably coupled to the housing and is positioned in and extends away from the front wall. The cleaning disk includes a plurality of bristles extending outwardly away from the head. A massage disk is rotatably coupled to the housing and is positioned in and extends away from the back wall. The massage disk includes a plurality of hemispherical massagers that are attached to and extend laterally away from the massage disk. A control circuit is mounted to the housing. The control circuit is actuated to rotate the cleaning disk and actuated to oscillate the massage disk.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
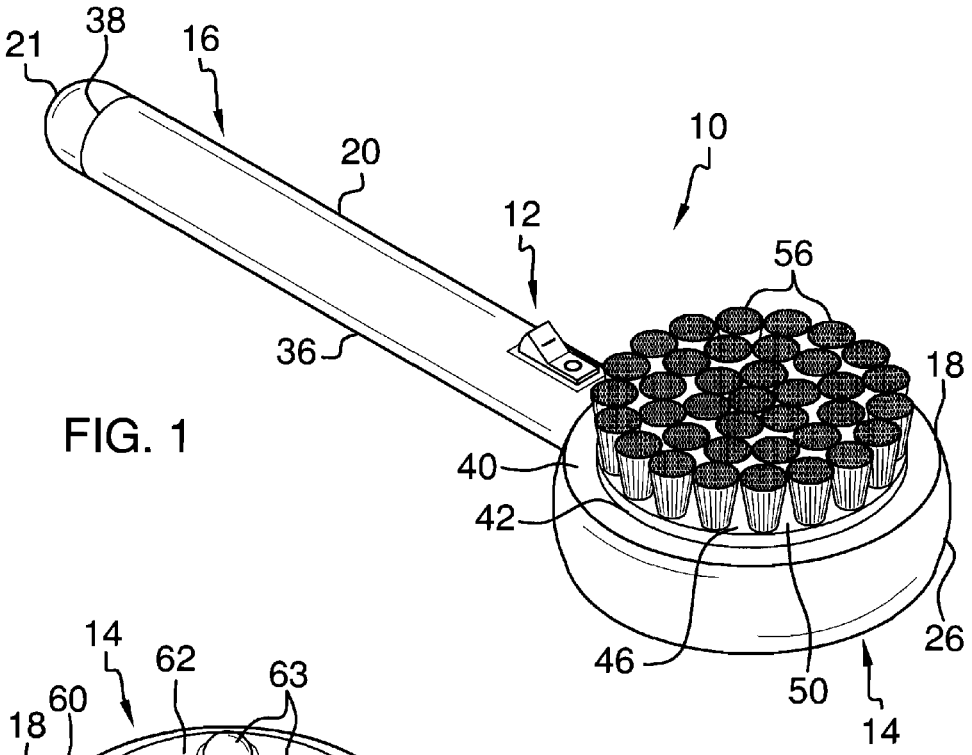
FIG. 1 is a front side perspective view of a skin cleaning assembly according to an embodiment of the disclosure.
Figure 2:
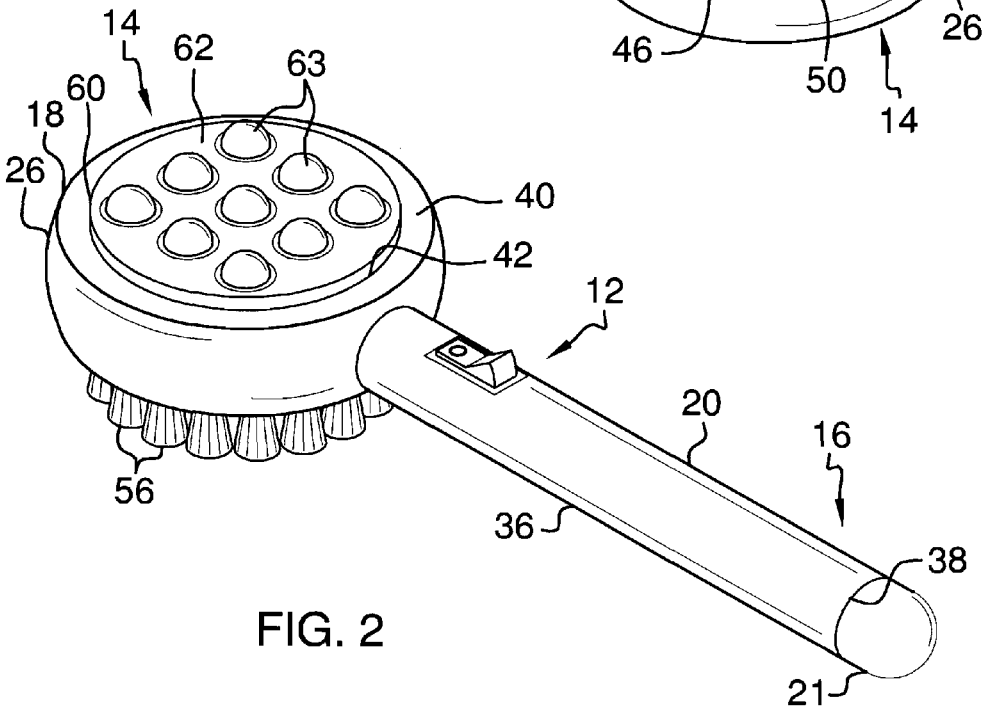
FIG. 2 is a back side perspective view of an embodiment of the disclosure.
Figure 3:
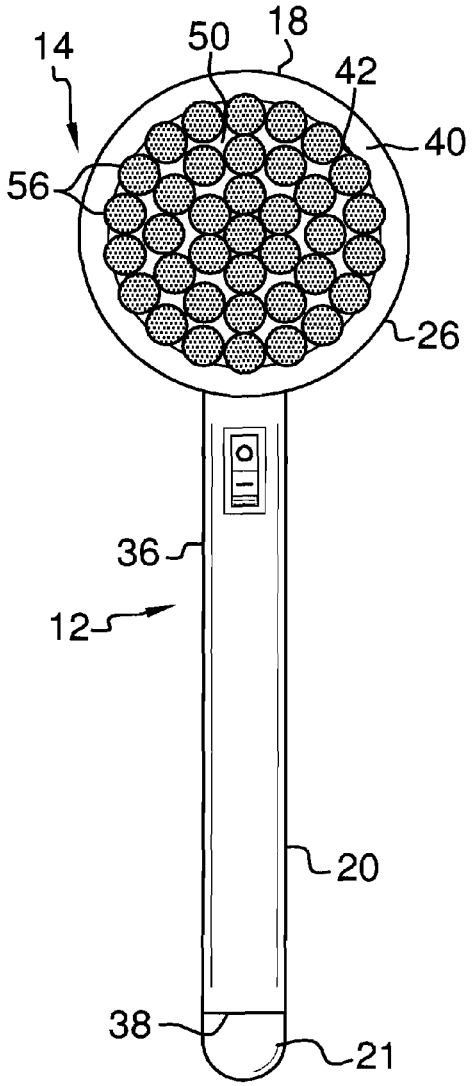
FIG. 3 is a front side view of an embodiment of the disclosure.
Figure 4:
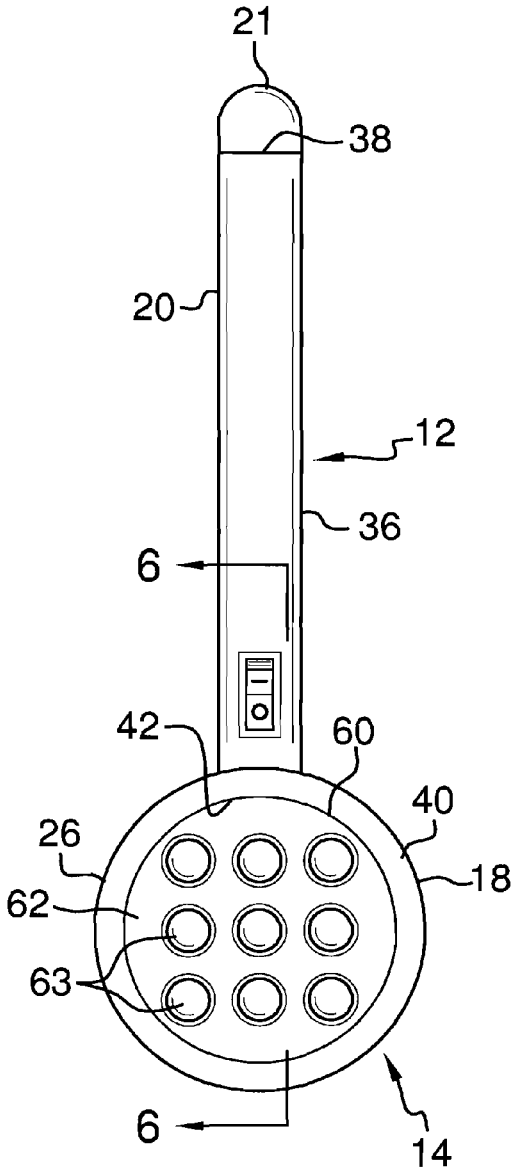
FIG. 4 is a back side view of an embodiment of the disclosure.
Figure 5:
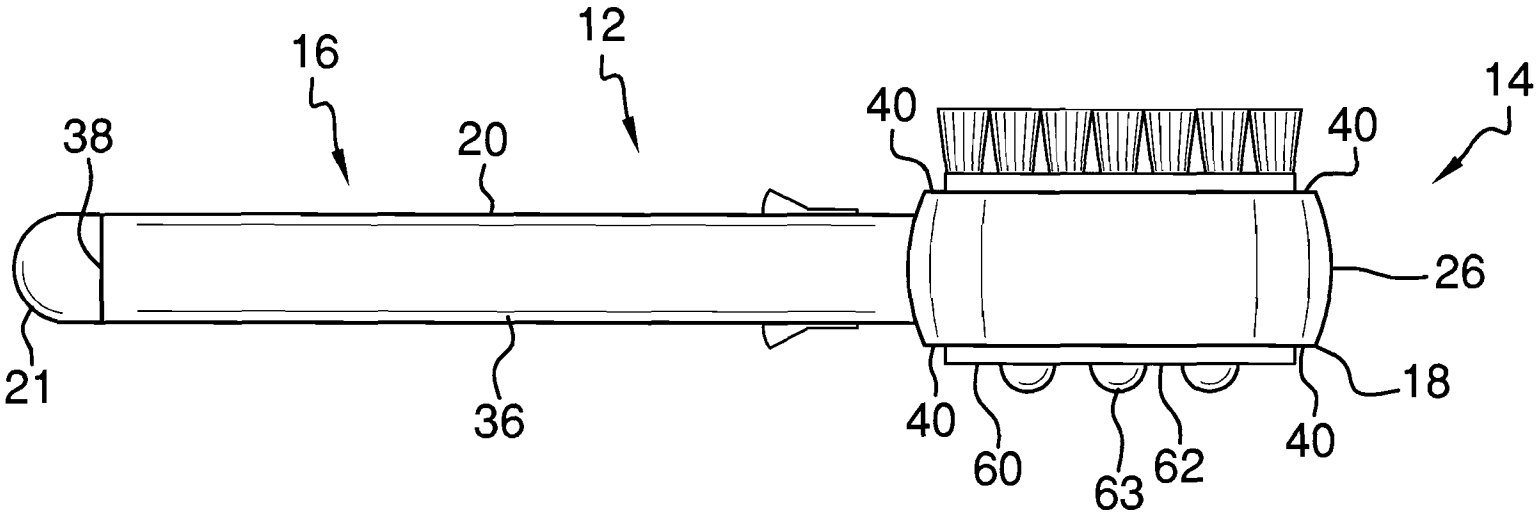
FIG. 5 is a right side view of an embodiment of the disclosure.
Figure 6:
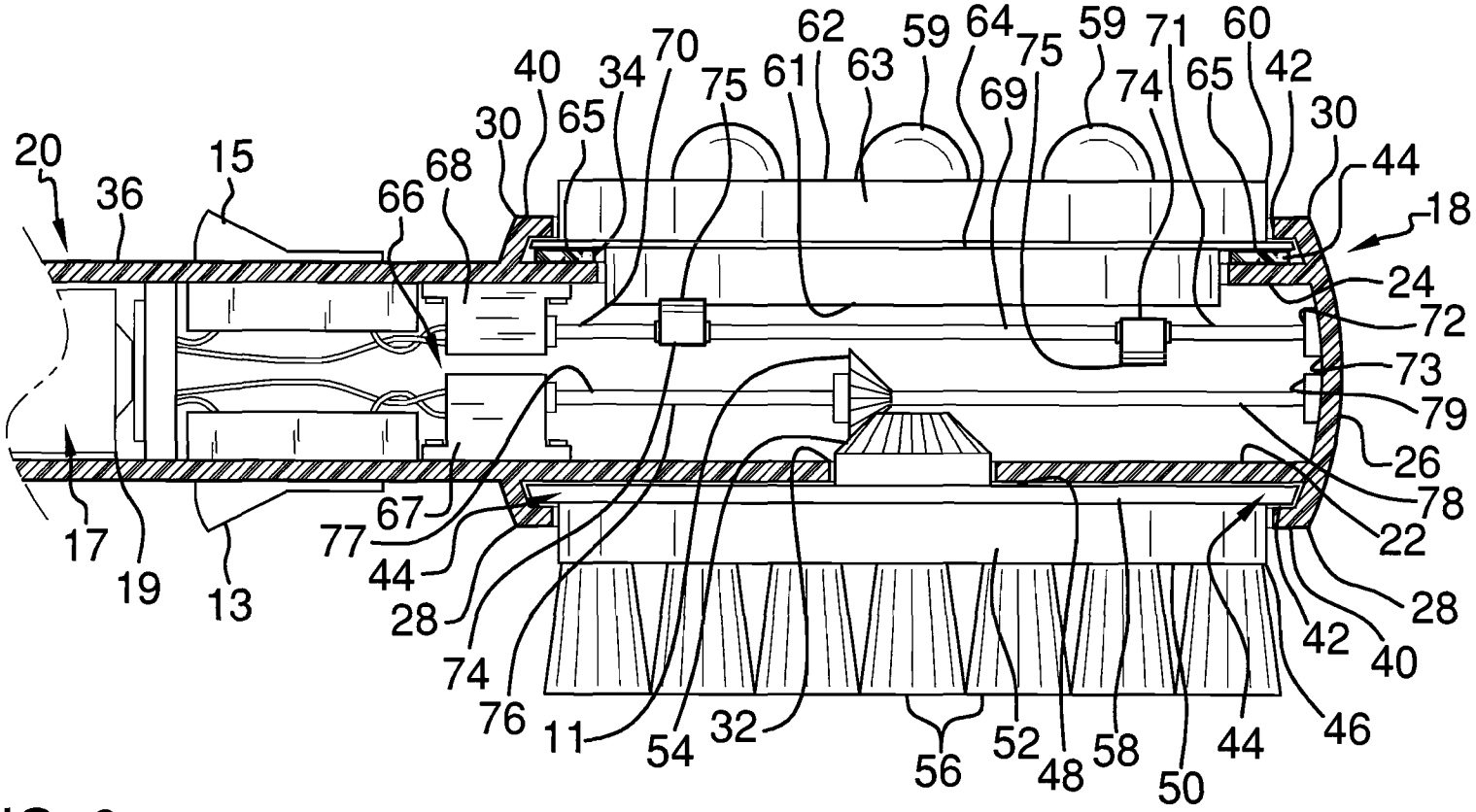
FIG. 6 is a cross sectional view taken along line 6-6 of FIG. 4 of an embodiment of the disclosure.
Figure 7:
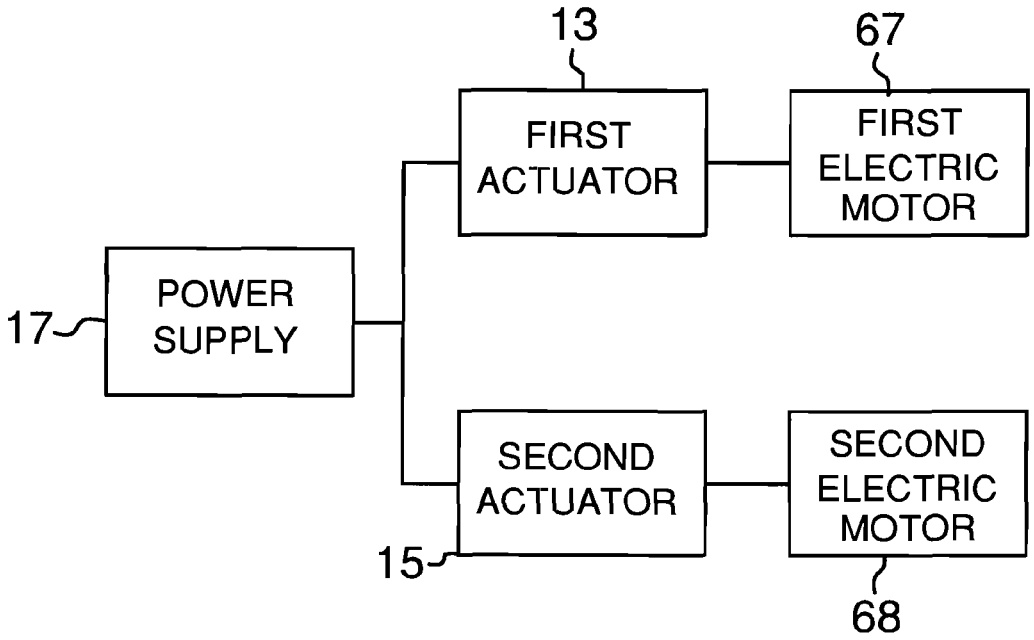
FIG. 7 is a schematic diagram of an embodiment of the disclosure.

With reference now to the drawings, and in particular to FIGS. 1 through 7 thereof, a new skin cleaning device embodying the principles and concepts of an embodiment of the disclosure and generally designated by the reference numeral 10 will be described.

As best illustrated in FIGS. 1 through 7, the skin cleaning assembly 10 generally comprises a housing 12 that has a first end 14 and a second end 16. The housing 12 is elongated along a longitudinal axis extending through the first 14 and second 16 ends. The first end 14 comprises a head 18 that has a circular shape. The second end 16 comprises a handle 20. The housing 12 may be comprised of a rigid and fluid impermeable material.

The head 18 includes a front wall 22, a back wall 24, and a perimeter wall 26 extending between the front 22 and back walls 24. The perimeter wall 26 has a convexly arcuate shape from the front wall 22 to the back wall 24. The perimeter wall 26 extends a distance beyond each of the front 22 and back 24 walls and the perimeter wall 26 includes a first edge 28 and a second edge 30. The front wall 22 has a brush aperture 32 extending therethrough. The back wall 24 has a massage aperture 34 extending therethrough to access an interior of the head 18.

The handle 20 has an outer wall 36 forming a hollow cylinder that has an open end 38 and has an interior that is in communication with the interior of the head 18. A pair of mounts 40 each is coextensively attached to and extends inwardly from corresponding ones of the first 28 and second 30 edges of the perimeter wall 26. Each of the mounts 40 is co-planar with a corresponding one of the front 22 and back 24 walls. Each of the mounts 40 defines a disk opening 42 and defines a flange space 44 between each of the mounts 40 and a corresponding one of the front 22 and back 24 walls. Each of the mounts 40 may be comprised of a rigid material.

A cleaning disk 46 is rotatably coupled to the housing 12 and is positioned upon and extends away from the front wall 22. The cleaning disk 46 is rotatably positioned within one of the disk openings 42. The cleaning disk 46 has a drive side 48, a cleaning side 50 and a perimeter edge 52. The cleaning disk 46 has a primary axis extending from the drive side 48 to the cleaning side 50. The cleaning disk 46 may be comprised of a rigid material.

The cleaning disk 46 includes a first gear 54 that is attached to and extends laterally away from the drive side 48 and extends through the brush aperture 32. The first gear 54 may have a frusto-conical shape. A plurality of brushes 56 is attached to and extends laterally away from the cleaning side 50. The brushes 56 may be comprised of a flexible material. A first flange 58 is attached to and extends outwardly from the perimeter edge 52 adjacent to the drive side 48 and is extended into a corresponding one of the flange spaces.

A massage disk 60 is rotatably coupled to the housing 12 and is positioned in and extends away from the back wall 24. The massage disk 60 is movably positioned in a remaining one of the disk openings 42 and extends through the massage aperture 34. The massage disk 60 has a cam side 61, a massage side 62 and an exterior edge 63. The massage disk 60 has a prime axis extending from the cam side 61 to the massage side 62. The massage disk 60 may be comprised of a rigid material.

The massage disk 60 includes a plurality of hemispherical massagers 59 that are attached to and extend laterally away from the massage side 62. Each of the massagers 59 may be comprised of a rigid material. A second flange 64 is attached to and extends outwardly away from the exterior edge 63 and is extended into a corresponding one of the flange spaces 44. A gasket 65 may be coextensively positioned between the second flange 64 and the back wall 24. The gasket 65 may be comprised of a resiliently compressible material.

A control circuit 66 is mounted to the housing 12. The control circuit 66 includes a first electric motor 67 that is mechanically engaged to the cleaning disk 46 and rotates the cleaning disk 46 when the first electric motor 67 is actuated to an on position. A second electric motor 68 is mechanically engaged to the massage disk 60 and oscillates the massage disk 60 when the second electric motor 68 is actuated. Each of the first 67 and second 68 electric motors may be hermetically sealed to prevent fluid infiltration into the first 67 and second 68 motors. Each of the first 67 and second 68 electric motors may have an operational voltage of more than 3 volts and less than 9 volts.

A massage shaft 69 is positioned adjacent to the cam side 61. The massage shaft 69 includes a primary end 70 and a secondary 71 end. The massage shaft 69 is elongated along a longitudinal axis extending through the primary 70 and secondary 71 ends. The massage shaft 69 is mechanically coupled to the first electric motor 67 and extends perpendicular to the prime axis through the interior of the head 18. The primary end 70 is coupled to the first electric motor.

A first bearing 72 may be attached to a distal inner surface 73 of the perimeter wall 26 with respect to each of the first 67 and second 68 electric motors. The secondary end 71 may rotatably engage the first bearing 72. A pair of cams 74 each is mounted on the massage shaft 69 to frictionally engage the cam side 61. Each of the cams 74 may have an extended end 75. Each of the cams 74 may be positioned on the massage shaft 69 so each of the extended ends 75 alternatively frictionally engages the cam side 61 to oscillate the massage disk 60.

A cleaning shaft 76 is positioned adjacent to the drive side 48. The cleaning shaft 76 includes a principle end 77 and an auxiliary end 78. The cleaning shaft 76 is elongated along a longitudinal axis extending through the principle 77 and auxiliary ends 78. The cleaning shaft 76 is mechanically coupled to the second electric motor 68 and extends perpendicular to the primary axis through the interior of the head 18. The principle end 77 is coupled to the second electric motor 68.

A second bearing 79 may be attached to the distal inner surface 73 of the perimeter wall 26. The auxiliary end 78 may rotatably engage the second bearing 79. A second gear 11 is positioned on the cleaning shaft 76 and mechanically engages the first gear 54 to rotate the cleaning disk 46. The second gear 11 may have a frusto-conical shape and the second gear 11 may engage the first gear 54 at a right angle to transfer rotational torque to the first gear 54. The second gear 11 may be comprised of a rigid material.

A first actuator 13 and a second actuator 15 each is positioned on the handle 20 and each is in electrical communication with a corresponding one of the first 67 and second 68 motors. Each of the first 67 and second 68 actuators is positionable in a first position to actuate a corresponding one of the first 67 and second 68 motors to the on position. Each of the first 13 and second 15 actuators is positionable in a second position to de-actuate the corresponding one of the first 67 and second 68 motors to an off position. Each of the first 67 and second 68 motors may be actuated and de-actuated individually or simultaneously. Each of the first 13 and second 15 switches may be hermetically sealed to prevent fluid infiltration into the first 13 and second 15 switches.

The first actuator 13 actuates the first electrical motor 67 to the on position to rotate the massage shaft 69. The second actuator actuates 15 the second electrical motor 68 to rotate the cleaning shaft 76. A power supply 17 is positioned within the interior of the handle 20 and is in electrical communication with each of the first 13 and second 15 actuators. The power supply 17 comprises at least one battery 19 and the power supply 17 may be hermetically sealed from the interior of the handle 20 to prevent fluid infiltration into the power supply 17. A cover 21 is removably positioned on the open end 38. The cover 21 may produce a hermetic seal with the handle 38.

In use, the first actuator may be positioned in the first position to rotate the cleaning disk for cleaning. The second actuator may be positioned in the first position to oscillate the massage disk for massaging. The first and second actuators may be positioned in the first or second positions individually or simultaneously.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A skin cleaning assembly configured for cleaning a person's body, said assembly comprising:

a housing having a first end and a second end, said housing being elongated along a longitudinal axis extending through said first and second ends, said first end comprising a head having a circular shape, said second end comprising a handle, said head including a front wall, a back wall, and a perimeter wall extending between said front and back walls, said perimeter wall having a convexly arcuate shape from said front wall to said back wall, said front wall having a brush aperture extending therethrough, said back wall having a massage aperture extending therethrough to access an interior of said head, said handle having an outer wall forming a hollow cylinder having an open end and having an interior being in communication with the interior of said head;

a pair of mounts each being coextensively attached to and extending inwardly from corresponding ones of a first and second edge of said perimeter wall, each of said mounts lying on a plane being co-planar with a corresponding one of said front and back walls, each of said mounts defining a head opening and defining a flange space between each of said mounts and a corresponding one of said front and back walls;

a cleaning disk being rotatably coupled to said housing and being positioned in and extending away from said front wall, said cleaning disk being rotatably positioned within one of said head openings, said cleaning disk having a drive side, a cleaning side and a perimeter edge, said cleaning disk having a primary axis extending from said drive side to said cleaning side, said cleaning disk including;

a first gear being attached to and extending laterally away from said drive side and extending through said brush aperture;

said plurality of brushes being attached to and extending laterally away from said cleaning side;

a first flange being attached to and extending outwardly from said perimeter edge adjacent to said drive side and being extended into a corresponding one of said flange spaces;

a massage disk being rotatably coupled to said housing and being positioned in and extending away from said back wall, said massage disk being movably positioned in a remaining one of said head openings and extending through said massage aperture, said massage disk having a cam side, a massage side and an exterior edge, said massage disk having a prime axis extending from said cam side to said massage side, said massage disk including;

said plurality of hemispherical massagers being attached to and extending laterally away from said massage side;

a second flange being attached to and extending outwardly away from said exterior edge and being extended into a corresponding one of said flange spaces;

a control circuit being mounted to said housing, said control circuit including;

a first electric motor being mechanically engaged to said cleaning disk and rotating said cleaning disk when said first electric motor is actuated to an on position;

a second electric motor being mechanically engaged to said massage disk and oscillating said massage disk when said second electric motor is actuated;

a massage shaft being positioned adjacent to said cam side, said massage shaft being mechanically coupled to said first one of said electric motors and extending perpendicular to said prime axis through the interior of said head to engage a distal inner surface of said perimeter wall with respect to each of said motors;

a pair of cams each being mounted on said massage shaft to frictionally engage said cam side;

a cleaning shaft being positioned adjacent to said drive side, said cleaning shaft being mechanically coupled to said second electric motor and extending perpendicular to said primary axis through the interior of said head to engage the distal inner surface of said perimeter wall;

a second gear being positioned on said cleaning shaft and mechanically engaging said first gear to rotate said cleaning disk;

a first actuator and a second actuator each being positioned on said handle and each being in electrical communication with a corresponding one of said first and second motors, each of said first and second actuators being positionable in a first position to actuate a corresponding one of said first and second motors to said on position, each of said first and second actuators being positionable in a second position to de-actuate the corresponding one of said first and second motors to an off position;

a power supply being positioned within the interior of said handle and being in electrical communication with each of said first and second actuators, said power supply comprising a battery; and a cover being removably positioned on said open end.

* * * * *